US006969276B2

(12) United States Patent
Ono et al.

(10) Patent No.: US 6,969,276 B2
(45) Date of Patent: Nov. 29, 2005

(54) METAL TERMINAL WITH WEAKENED PART

(75) Inventors: Shuji Ono, Shizuoka (JP); Hiroaki Arai, Shizuoka (JP); Hiroki Goto, Shizuoka (JP); Masahiro Takamatsu, Aichi (JP); Koji Nomura, Aichi (JP); Shyunsaku Takeuchi, Aichi (JP); Keiichi Ito, Aichi (JP); Yoshihide Tsukamoto, Aichi (JP); Masanori Wakui, Aichi (JP); Isao Yoneyama, Aichi (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/490,867

(22) PCT Filed: Sep. 26, 2002

(86) PCT No.: PCT/JP02/09936

§ 371 (c)(1),
(2), (4) Date: Aug. 17, 2004

(87) PCT Pub. No.: WO03/028163

PCT Pub. Date: Apr. 3, 2003

(65) Prior Publication Data

US 2005/0003703 A1 Jan. 6, 2005

(30) Foreign Application Priority Data

Sep. 26, 2001 (JP) ..... 2001-293999
Aug. 30, 2002 (JP) ..... 2002-256079

(51) Int. Cl.[7] ..... H01R 29/00
(52) U.S. Cl. ..... 439/518; 439/474; 439/287; 439/883; 439/907

(58) Field of Search ..... 439/516, 287, 439/907, 284, 288, 883, 801, 772, 504, 759, 439/369–370, 854, 522, 350, 757, 761, 431–433, 439/773, 474, 475; 174/87 C

(56) References Cited

U.S. PATENT DOCUMENTS 4,273,401 A * 6/1981 Katzin ..... 439/286

(Continued)

FOREIGN PATENT DOCUMENTS

DE 30 48 497 A1 7/1982

(Continued)

*Primary Examiner*—Gary Paumen
*Assistant Examiner*—Edwin A. Leon
(74) *Attorney, Agent, or Firm*—Finnegan, Henderson, Farabow, Garett & Dunner, L.L.P.

(57) ABSTRACT

A metal terminal has a terminal body having a crimp part crimped to a wire and a fastening part connected to the terminal body through breaking parts. The fastening part has a through-hole for passage of a bolt. The metal terminal further includes a co-fastening part formed in the terminal body. The tip side of the co-fastening part is fastened to a vehicle body by the bolt, together with the fastening part. When detaching the terminal body from the vehicle body, one side of the one terminal body is pulled up in a direction opposite to the fastening direction of the bolt under condition that the fastening part and the co-fastening part are together fastened by the bolt. Consequently, the co-fastening part is released from its fastened condition and a breaking force is applied on the breaking parts.

18 Claims, 12 Drawing Sheets

U.S. PATENT DOCUMENTS 5,759,056 A * 6/1998 Costello et al. ..... 439/290
6,126,493 A * 10/2000 Price et al. ..... 439/801
6,206,718 B1 * 3/2001 Takahashi et al. ..... 439/382
6,530,795 B2 * 3/2003 Maeda et al. ..... 439/287
6,786,751 B2 * 9/2004 Maeda et al. ..... 439/287

FOREIGN PATENT DOCUMENTS

EP 01 017 129 A2 7/2000

* cited by examiner

PRIOR ART

PRIOR ART

PRIOR ART

METAL TERMINAL WITH WEAKENED PART

TECHNICAL FIELD

The present invention relates to a metal terminal, alias, metal fittings attached to a vehicle by means of a fastening member while the metal terminal is connected with an end of a wire.

BACKGROUND ART

FIG. 1 shows a proposed metal terminal 1. The metal terminal 1 includes a plate-shaped terminal body 3 provided, on one side in the longitudinal direction, with a crimp part 5 which is crimped to a not-shown wire. On the other side of the terminal body 3, it has a fastening part 11 having a through-hole (not shown) formed to let a bolt 7 as the fastening member pass.

When using the metal terminal 1, the crimp part 5 is firstly crimped to the wire's end having its insulating cover peeled and thereafter, the fastening part 11 is fastened to a vehicle body 13 by means of the bolt 7. In fastening the part 11 to the vehicle body 13, the bolt 7 is inserted into the above through-hole of the part 11 while interposing a washer 15 between the bolt 7 and the part 11 and subsequently, the leading end of the bolt 7 is screwed into a boss, a nut or the like (not shown). In this state, the metal terminal 1 serves to fix the end of the wire to the vehicle body 13 and further connect the wire with the body 13 electrically.

Meanwhile, when grounding (earthing) instruments to the vehicle body, it has been carried out to gather a plurality of wires for connection. Then, a metal terminal as shown in FIGS. 2 and 3 is employed.

This metal terminal 2 includes a plurality of plate-shaped terminal bodies 4*a*, 4*b* each provided, on one side in the longitudinal direction, with the crimp part 5 which is crimped to a wire W. On the other side in the longitudinal direction, the terminal bodies 4*a*, 4*b* include respective fastening parts 8*a*, 8*b* having through-holes 6*a*, 6*b* for passage of the bolt 7, respectively. For mutual engagement, the fastening parts 8*a*, 8*b* are provided with engagement parts 10*a*, 10*b*, respectively.

Regarding the method of using this metal terminal 2, the crimp parts 5, 5 of the bodies 4*a*, 4*b* are firstly crimped to the wires' ends having their insulating covers peeled. Then, the fastening parts 8*a*, 8*b* are laid to overlap each other and engaged into one body by the mutual engagement of the engagement parts 10*a*, 10*b*. Thereafter, as shown in FIG. 3, the bolt 7 is inserted into the overlapped through-holes 6*a*, 6*b* while interposing the washer 15 between the bolt 7 and the upper fastening part 8*a* and subsequently, the leading end of the bolt 7 is screwed into a boss, a nut or the like (not shown), fastening the terminal 2 to the vehicle body 13 (FIG. 1).

In this state, the metal terminal 2 serves to fix the respective ends of the wires w, w to the vehicle body 13 collectively and further connect the wires w, w with the vehicle body 13 electrically.

In common with the above-mentioned terminals 1, 2, however, a tool for unscrewing the bolt 7 from the vehicle body 13 is indispensable to the detaching operation of the wire(s) w from the vehicle body 13, which is often necessary in dissolving the vehicle for its separable disposal, recycling, etc. Therefore, the metal terminals 1, 2 mentioned above have a problem of taking a great deal of time to detach the wire(s) from the vehicle body 13, causing a troublesome disassemble work.

DISCLOSURE OF INVENTION

Under the circumstances, it is therefore an object of the present invention to provide a metal terminal which is capable of detaching the wire(s) from the metal terminal without detaching a fastening member, such as a bolt, therefrom.

The object of the present invention described above can be accomplished by a metal terminal comprising:

- a terminal body made from a metal plate, the terminal body having a crimp part which is to be crimped to a wire;
- a fastening part connected to the terminal body through at least one weakened part, the fastening part having a through-hole formed therein for passage of a fastening member; and
- a co-fastening part formed in the terminal body, the co-fastening part having its tip side to be fastened by the fastening member together with the fastening part;
- wherein, when the terminal body is pulled to a direction opposite to the fastening direction of the metal terminal by means of the fastening member under condition that the fastening part and the co-fastening part are together fastened by the fastening member, the co-fastening part is released from its fastened condition and also apply a breaking force on the weakened part.

With the above structure of the metal terminal, by pulling the terminal body to the opposite direction of the fastening direction by the fastening member under condition that the fastening part and the co-fastening part are together fastened by the fastening member, the tip side of the co-fastening part is released from its fastened condition and furthermore, the breaking force is produced to break the weakened part.

Additionally, since the fastening part and the tip side of the co-fastening part are together fastened by the fastening member, it is possible to fix the terminal body to an object, such as vehicle body, together with fastening part certainly.

In the second aspect of the present invention, the weakened part is formed along the longitudinal direction of the terminal body, and the breaking force is produced by pulling the terminal body in the direction opposite to the fastening direction while making a fulcrum of either one side of the terminal body in the longitudinal direction or the other side of the terminal body.

According to the second aspect of the invention, since the weakened part is formed along the longitudinal direction of the terminal body, it is possible to allow the above pulling force to function as a breaking force to break the weakened part.

In the third aspect of the present invention, the fastening part is formed so as to intersect with the longitudinal direction of the terminal body and the weakened parts are arranged on both sides of the fastening part.

According to the third aspect of the invention, since the weakened parts are arranged on both sides of the fastening part intersecting with the longitudinal direction of the terminal body, there is no possibility that the terminal body clatters in a direction intersecting with the fastening direction by the fastening member.

In the fourth aspect of the present invention, the co-fastening part is arranged so as to oppose the fastening part in the longitudinal direction of the terminal body.

According to the fourth aspect of the invention, by fastening the tip side of the co-fastening part by means of the fastening member, it is possible to fix the terminal body to the vehicle body more certainly.

In the fifth aspect of the present invention, the through-hole is formed so as to open toward the co-fastening part.

According to the fifth aspect of the invention, owing to the opening structure of the through-hole, the fastening force of the fastening member is prevented from being dispersed between the co-fastening part and the fastening member, whereby it is possible to transmit the fastening force of the fastening member to the co-fastening part certainly.

In the sixth aspect of the present invention, the terminal body has at least one rib formed along the weakened part to increase rigidity of the terminal body.

According to the sixth aspect of the invention, owing to the provision of the rib, it is possible to prevent the terminal body from being deflected when pulling up the other side of the terminal body. Thus, the breaking force can be produced at the weakened part by an operator's force to pull up the other side of the terminal body.

In the seventh aspect of the present invention, the weakened part includes a part which is formed thinner than the fastened part.

In this case, it is possible to break the weakened part more easily.

In the eighth aspect of the present invention, the weakened part includes a plurality of orifices formed to line up along the fastening part at regular intervals.

Also in this case, it is possible to break the weakened part more easily.

In the ninth aspect of the present invention, there is also provided a metal terminal comprising:

a plurality terminal bodies made from metal plates, the terminal bodies each having a crimp part which is to be crimped to a wire;

a plurality of fastening parts connected to the terminal bodies through weakened parts respectively, the fastening parts each having a through-hole formed therein for passage of a fastening member; and a plurality of engaging parts formed in the fastening parts respectively to allow the fastening parts to be engaged with each other;

wherein, when the terminal body is pulled to a direction opposite to the fastening direction of the fastening parts by means of the fastening member under condition that the fastening parts are engaged with each other by the engaging parts and further fastened by the fastening member, the metal terminal produces a breaking force acting on the weakened part.

With the above structure of the metal terminal, by pulling the terminal bodies to the opposite direction of the fastening direction by the fastening member under condition that the fastening parts engaged with each other through the engaging parts are fastened by the fastening member, the breaking force is produced at the weakened parts to break them.

In the 10th. aspect of the present invention, the weakened parts are formed along the longitudinal direction of the terminal bodies respectively, and the breaking force is produced by pulling the terminal bodies in the direction opposite to the fastening direction while making a fulcrum of either one sides of the terminal bodies in the longitudinal direction or the other sides of the terminal bodies.

According to the 10th. aspect of the invention, since the weakened parts are formed along the longitudinal direction of the terminal bodies, it is possible to allow the above pulling force to function as a breaking force to break the weakened parts.

In the 11th. aspect of the present invention, the weakened parts are curved partially.

According to the 11th. aspect of the invention, owing to the curved configuration of the weakened parts, they are prevented from being broken by an unintentional force and are fixed to the vehicle body certainly.

In the 12th. aspect of the present invention, each of the terminal bodies has at least one rib formed along the weakened part to increase rigidity of the terminal body.

According to the 12th. aspect of the invention, owing to the provision of the ribs, it is possible to prevent the terminal bodies from being deflected when pulling up the other sides of the terminal bodies. Thus, the breaking force can be produced at the weakened parts by an operator's force to pull up the other sides of the terminal bodies.

In the 13th. aspect of the present invention, each of the weakened part includes a part which is formed thinner than each of the fastened part.

In this case, it is possible to break the weakened part more easily.

In the 14th. aspect of the present invention, each of the weakened parts includes a plurality of orifices formed to line up along each of the fastening parts at regular intervals.

Also in this case, it is possible to break the weakened part more easily.

In the 15th. aspect of the present invention, each of the weakened parts has a thick-wall part which is thicker than a breakable end of the weakened part where the breaking force is to be applied at first, the breakable end being thinner than the fastening part.

According to the 15th. aspect of the invention, owing to the provision of the thick-wall part of each of the weakened parts, the sectional area of the weakened part is increased for the thick-wall part. This means increasing an electrical mass of the weakened part, allowing the metal terminal to be small-sized. Additionally, the rigidity of the weakened parts is improved by the thick-wall parts. Therefore, in fastening each of the fastening parts by the fastening member, its fastening force is received by the thick-wall part, preventing the weakened part from being broken due to the fastening force unintentionally.

Further, when breaking the weakened parts forcibly, the breakage of the weakened parts starts from the breakable ends because of their thinness. With the progress of breakage of the weakened parts, the shearing stress applied thereon is gradually increased so as to break even the thick-wall parts. That is, it is possible to accomplish the breakage of the weakened parts in spite of the presence of the thick-wall parts.

In the 16th. aspect of the present invention, each of the weakened parts is formed so as to gradually increase a plate thickness from the breakable end toward the thick-wall part.

According to the 16th. aspect of the invention, owing to the above formation of the weakened parts, it is possible to accomplish the breakage of the thick-wall parts smoothly, corresponding to the breakage of the breakable ends.

In the 17th. aspect of the present invention, each of the thick-wall parts is arranged on the opposite side of the breakable end of each of the weakened parts.

According to the 17th. aspect of the invention, since the thick-wall part is positioned apart from the breakable end of the weakened part, the rigidity of the thick-wall part is hard to affect the initial breakage of the weakened part. Therefore, since a large breaking, force is easy to be produced at the thick-wall parts, it is possible to accomplish the breakage of the weakened parts in spite of the presence of the thick-wall parts.

In the 18th. aspect of the present invention, the thick-wall part has a plate thickness substantially equal to the plate thickness of each of the terminal bodies and also the plate thickness of each of the fastening parts and is formed so as to succeed to the terminal body and the fastening part continuously.

According to the 18th. aspect of the invention, owing to the continuous formation between the terminal body and the fastening part, it is possible to increase the electrical mass of each of the weakened parts and also possible to improve the rigidity of the weakened part at the thick-wall part.

These and other objects and features of the present invention will become more fully apparent from the following description and appended claims taken in conjunction with the accompany drawings.

BEST MODE FOR CARRYING OUT THE INVENTION

Embodiments of the present invention will be described with reference to the drawings.

[1st. Embodiment]

Figure 4:
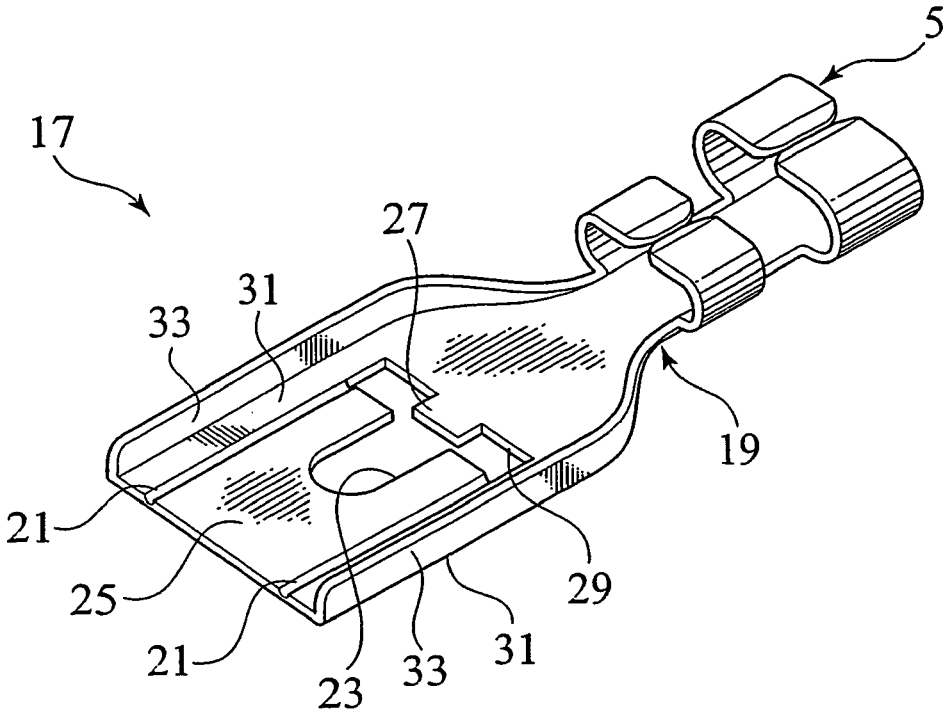
FIG. 4 is a perspective view of a metal terminal in accordance with the first embodiment of the present invention.
Figure 5:
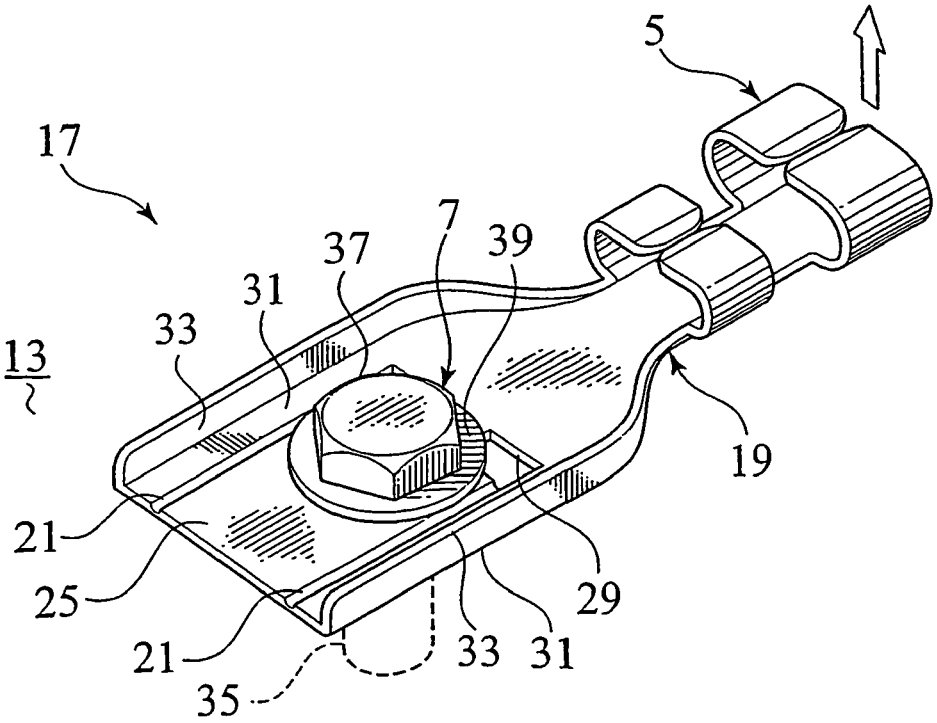
FIG. 5 is a perspective view showing a condition that the metal terminal of FIG. 4 is fixed to the vehicle body.
Figure 6:
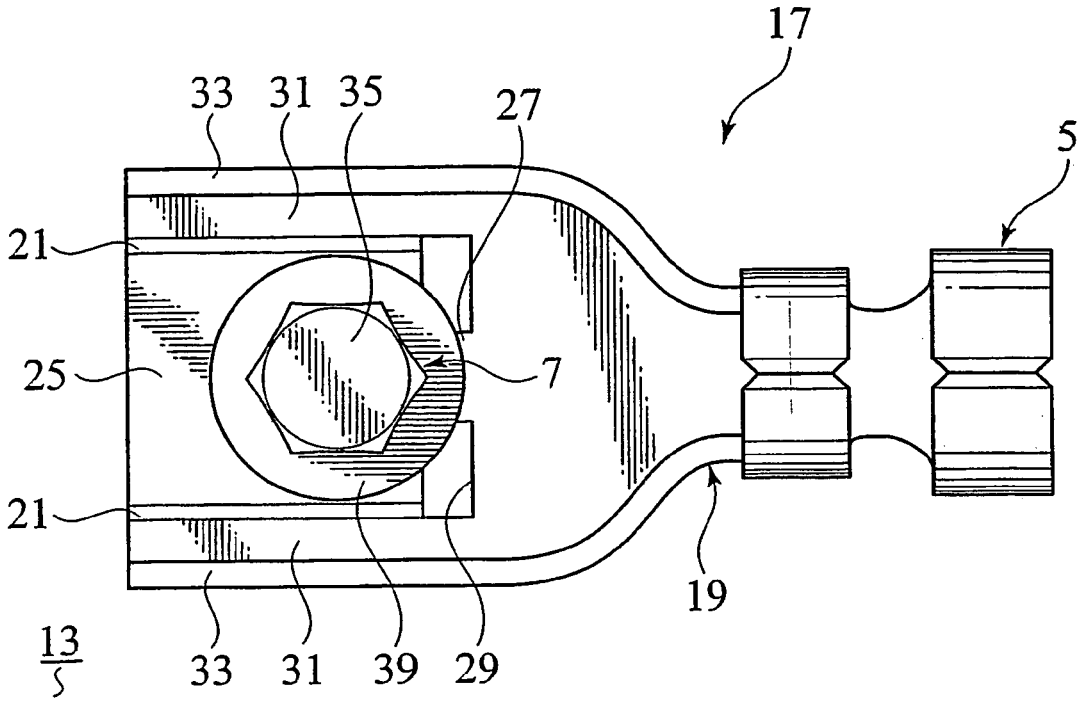
FIG. 6 is a plan view of the metal terminal of FIG. 5

FIG. 4 is a perspective view of a metal terminal in accordance with the first embodiment of the present invention. FIG. 5 is a perspective view showing a condition that the metal terminal of FIG. 4 is fixed to the vehicle body. FIG. 6 is a plan view of the metal terminal of FIG. 5.

In these figures, reference numeral 17 designates a metal terminal (fittings) of this embodiment. The metal terminal 17 has a plate-shaped terminal body 19 having a crimp part 5 which is crimped to a not-shown wire and a fastening part 25 connected to the terminal body 19 through breakable weakened parts 21, 21 and having a through-hole 23 for passage of a bolt 7 as a fastening member. Noted that the above weakened parts 21, 21 will be referred to "breaking parts" hereinafter. The terminal body 19 is provided with a co-fastening part 27 of which tip side is fastened by the bolt 7, together with the fastening part 25.

The terminal body 19 is made from an elongated metal plate. Again, the terminal body 19 is shaped so that one side thereof in the longitudinal direction expends in the direction of width, in comparison with the other side of the terminal body 19 in the longitudinal direction. The terminal body 19 has a pair of projecting parts 31, 31 formed to project from one end face 29 along the longitudinal direction, on both sides in the direction of width of the body 19. The projecting parts 31, 31 are arranged to oppose each other at a predetermined pitch. On one side of each projecting part 31, a rib 33 is formed to extend from the top of the projecting part toward the other side of the terminal body 19. The rib 33 is also formed to project upward on the opposite side to the fastening direction of the bolt 7. Therefore, owing to the provision of the ribs 33, 33, the rigidity of the projecting parts 31, 31 can be enhanced in the terminal body 19. Further, the terminal body 19 is provided, on the other side in the longitudinal direction, with the crimp part 5.

As obviously shown in FIG. 6, the above-mentioned co-fastening part 27 is in the form of a rectangular plate which is relatively long in the width direction of the terminal body 19. The co-fastening part 27 is also formed to project from the intermediate part of the end face 29 of the body 19 in the longitudinal direction. The tip (side) of the co-fastening part 27 is flexible with respect to the base (side) of the part 27 providing a fulcrum of flexibility.

Connected with the terminal body 19 through the breaking parts 21, 21 is the fastening part 25 which exists on one side of the terminal body 19 in the longitudinal direction. As shown in FIGS. 4 to 6, the breaking parts 21, 21 are thinned in comparison with the plate thickness of the terminal body 19 to have flexibility. Again, the breaking parts 21, 21 are formed to extend from the tips of the projecting parts 31, 31 up to the vicinity of the tip of the co-fastening part 27 along the longitudinal direction of the parts 31, 31. Consequently, when the terminal body 19 is pulled up and down with respect to the fastening part 25, a shearing force is produced for breakage of the breaking parts 21, 21.

The fastening part 25 is in the form of a rectangular plate. The fastening part 25 has its longitudinal dimension substantially equal to the longitudinal dimension of the breaking part 21. Also, the fastening part 25 has its width dimension somewhat smaller than a pitch (distance) between the projecting parts 31, 31.

The fastening part 25 is connected, on both sides in the width direction, with the breaking parts 21, 21. The fastening part 25 is arranged between the projecting parts 31, 31 to extend along the longitudinal direction of the terminal body 19. Of course, it is defined that the width direction of the fastening part 25 intersects with the longitudinal direction of the terminal body 19. The fastening part 25 is formed so that its end (in the longitudinal direction) aligns with the tips of the projecting parts 31, 31 and the other end (in the longitudinal direction) terminates on the way to the respective bases of the projecting parts 31, 31 while leaving a space against the end face 29 of the terminal body 19.

That is, the co-fastening part 27 is positioned between both sides of the fastening part 25 in the wide direction and positioned on the other side of the part 25 in the longitudinal direction. As mentioned before, the fastening part 25 is provided with the through-hole 23 for passage of the bolt 7.

The through-hole 23 is shaped to be concave in plan view. Extending from one end of the fastening part 25 to the other end along the longitudinal direction of the part 25, the through-hole 23 opens against the co-fastening part 27 to communicate with the space between the part 25 and the terminal body 19. The through-hole 23 is provided, on the opposite side to the co-fastening part 27, with an inner periphery whose curvature is substantially equal to the curvature of a male screw 35 of the bolt 7. The through-hole 23 has its longitudinal dimension larger than the diameter of the male screw 35 and a width-directional dimension substantially equal to or somewhat larger than the diameter of the male screw 35.

When using the metal terminal 17 constructed above, it is first carried out to caulk the crimp part 5 to the wire's end having its insulating cover peeled. Subsequently, the fastening part 25 is fastened to the vehicle body 13 by the bolt 7.

In fastening the fastening part 25 to the vehicle body 13 by the bolt 7, it is carried out to insert the bolt 7 into the through-hole 23 while allowing the outer periphery of the male screw 35 to abut against the inner periphery of the hole 23. At this time, a washer 41 is interposed between the fastening part 25 an a screw head 37 of the bolt 7. Noted that dimensions (e.g. diameter) of the washer 41 are established so that it does not project from the fastening part 25 in the width direction and that the washer 41 lies on the tip side of the co-fastening part 27 partially.

Then, by thread-engaging the end of the male screw part 35 with a not-shown boss or nut, the fastening part 25 and the tip of the co-fastening part 27 are fastened by the bolt 7 through the washer 41.

In this state, since the terminal body 19 is fixed to the vehicle body 13, the wire is electrically connected with the vehicle body 13. In the metal terminal 17, the co-fastening part 27 is mechanically fastened to the vehicle body 13 by the bolt 7, together with the fastening part 25.

In the metal terminal 17, since the through-hole 23 opens against the co-fastening part 27, the fastening force owing to the bolt 7 can be prevented from being dispersed between the co-fastening part 27 and the bolt 7, transmitting the fastening force of the bolt 7 to the co-fastening part 27 certainly.

In the modification, as for the fastening of the fastening part 25 to the vehicle body 13 through the bolt 7, the washer 41 may be removed.

When detaching the metal terminal 17 from the vehicle body 13, it is performed to pull up the other side of the terminal body 17, as shown with an arrow of FIG. 5.

If pulling up the other side of the terminal body 17, then the co-fastening part 27 is brought into condition that its base part is apt to move upwardly. Nevertheless, as the tip part of the co-fastening part 27 is still secured to the vehicle body 13 by the bolt 7, there is produced a deflection between the tip part and the base part of the co-fastening part 27, so that the base part is inclined to the base part upwardly.

In other words, the other side of the terminal body 19 moves upward in relation to the projecting parts 31, 31. Thus, the terminal body 19 partially pivots about the tips of the parts 31, 31 as fulcrums while bending the breaking part 21, 21 against the fastening part 25. Simultaneously, with the pivotal movement of the terminal body 19, the tip side of the co-fastening part 27 is displaced toward the outer periphery of the washer 51 gradually.

When the terminal body 19 is brought into a designated rotational position, the tip side of the co-fastening part 27 is arranged outside the outer periphery of the washer 41, eluding the tightening of the bolt 7.

When further pulling up the other side of the terminal body 19 from the above condition, the breaking parts 21, 21 between the fastening part 25 and the projecting parts 31, 31 are pulled up and down with the pivotal movement of the terminal body 19. Consequently, there is produced a shear stress about the projecting parts 31, 31. Thus, due to the shear stress, the breaking parts 21, 21 are gradually torn from their ends close to the bases of the projecting parts 31, 31 toward the respective tips of the parts 21, 21. Noted that the above ends of the breaking parts 21, 21 may be referred to "breakable ends" in the specification.

Again noted that the breaking parts 21, 21 are formed along the longitudinal direction of the terminal body 19. Therefore, the pulling force on the other side of the terminal body 19 can be mostly converted to a shear force for tearing the breaking parts 21, 21, facilitating their breakage. As a result, it is possible to perform the dissolving work with ease.

Additionally, since the rigidity of the projecting parts 31, 31 is improved by the addition of the ribs 33, 33, it is possible to prevent the parts 31, 31 from being deflected during pulling up the other side of the terminal body 19. Accordingly, it is possible to allow the pulling force on the other side of the terminal body 19 to function as the shearing force for tearing the breaking parts 21, 21, also facilitating their breakage.

Figure 7:
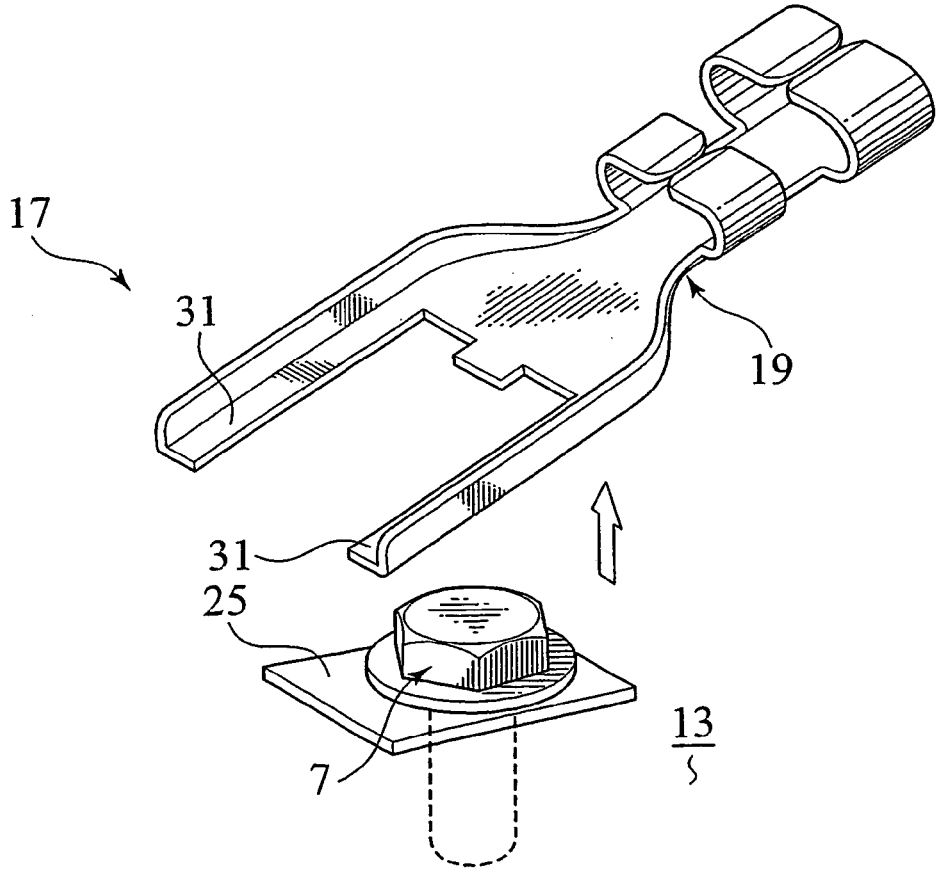
FIG. 7 is a perspective view of the metal terminal of FIG. 5, showing a condition that a breaking part of the terminal is broken.

At the stage of complete breaking of the parts 21, 21, as shown in FIG. 7, the fastening part 25 is separated from the terminal body 19. That is, the terminal body 10 is released from its fixed condition on the vehicle body 13. In this way, it becomes possible to detach the end of the wire from the vehicle body 13, together with the terminal body 19.

In summary, according to the metal terminal 17 of the above-mentioned embodiment, by pulling up the other side of the terminal body 19, it is possible to cancel the fastening of the bolt 7 about the tip side of the co-fastening part 27 and also possible to break the breaking parts 21, 21 due to the resultant shearing force.

Therefore, without using any exclusive tool, it is possible to separate the fastening part 25 from the terminal body 19 and also possible to detach the terminal body 19 having the end of the wire from the vehicle body 13, allowing a worker to disassemble the vehicle with ease.

Again in the metal terminal 17, since the tip side of the co-fastening part 27 and the fastening part 25 are together fastened to the vehicle body 13 by the bolt 7, the terminal body 19 can be fixed on the vehicle body 13 certainly, together with the fastening part 25. Thus, since the metal terminal 17 of this embodiment has no clattering of the terminal body 19 in relation to the fastening part 25, it is possible to prevent the breaking part 21, 21 from being broken by an unintentional force, whereby the electrical connection can be effected between the electrical wire and the vehicle body 13.

In addition, since the metal terminal 17 includes the fastening part 25 connected, on both sides thereof in the width direction, with the terminal body 19 through the breaking parts 21, 21, there is produced no pivot of the terminal body 19 about the breaking parts 21, 21 as fulcrums. Therefore, it is possible to prevent the breaking part 21, 21 from being broken by an unintentional force more certainly.

Since the metal terminal 17 has the co-fastening part 27 formed at the intermediate part of the end face 20 of the terminal body 19 and also arranged near the other side of the fastening part 25 and between both sides thereof in the width direction, it is possible to accomplish the fixing of the terminal body 19 on the vehicle body 13 by using the bolt 7 more certainly. Thus, it is also possible to prevent the breaking part 21, 21 from being broken by an unintentional force more certainly.

Repeatedly, since the through-hole 23 opens against the co-fastening part 27, the fastening force owing to the bolt 7 can be prevented from being dispersed between the co-fastening part 27 and the bolt 7, transmitting the fastening force of the bolt 7 to the co-fastening part 27 certainly. Also by this reason, it is possible to accomplish the fixing of the terminal body 19 on the vehicle body 13 more certainly and also possible to prevent the breaking part 21, 21 from being broken by an unintentional force more certainly.

Repeatedly, since the rigidity of the projecting parts 31, 31 is improved by the addition of the ribs 33, 33, it is possible to prevent the parts 31, 31 from being bent when pulling up the other side of the terminal body 19. Accordingly, it is possible to convert the pulling force on the other side of the terminal body 19 to a shearing force for tearing the breaking parts 21, 21, whereby they can be broken thereby accomplishing the disassembling work more easily.

It goes without mentioning that the thin-formation of the breaking parts 21, 21 facilitates their tearing produced by pulling up the other side of the terminal body 19.

Various changes and modifications may be made to the first embodiment. For example, the metal terminal 17 may be provide, on one side of the fastening part 25 in the width direction, with the only one breaking part 21, while two breaking parts 21, 21 are arranged on both sides of the part 25 in the shown embodiment. Further, the breaking parts 21, 21 may be formed in the width direction of the terminal body 19 instead of the longitudinal direction.

Although the through-hole 23 is formed to open against the co-fastening part 27, the through-hole 23 may be provided with no opening in the modification.

In addition, the thin-walled breaking parts 21, 21 may be replaced by a plurality of orifices lined up between the fastening part 25 and the projecting parts 31, 31 at regular intervals.

[2nd Embodiment]

Figure 8:
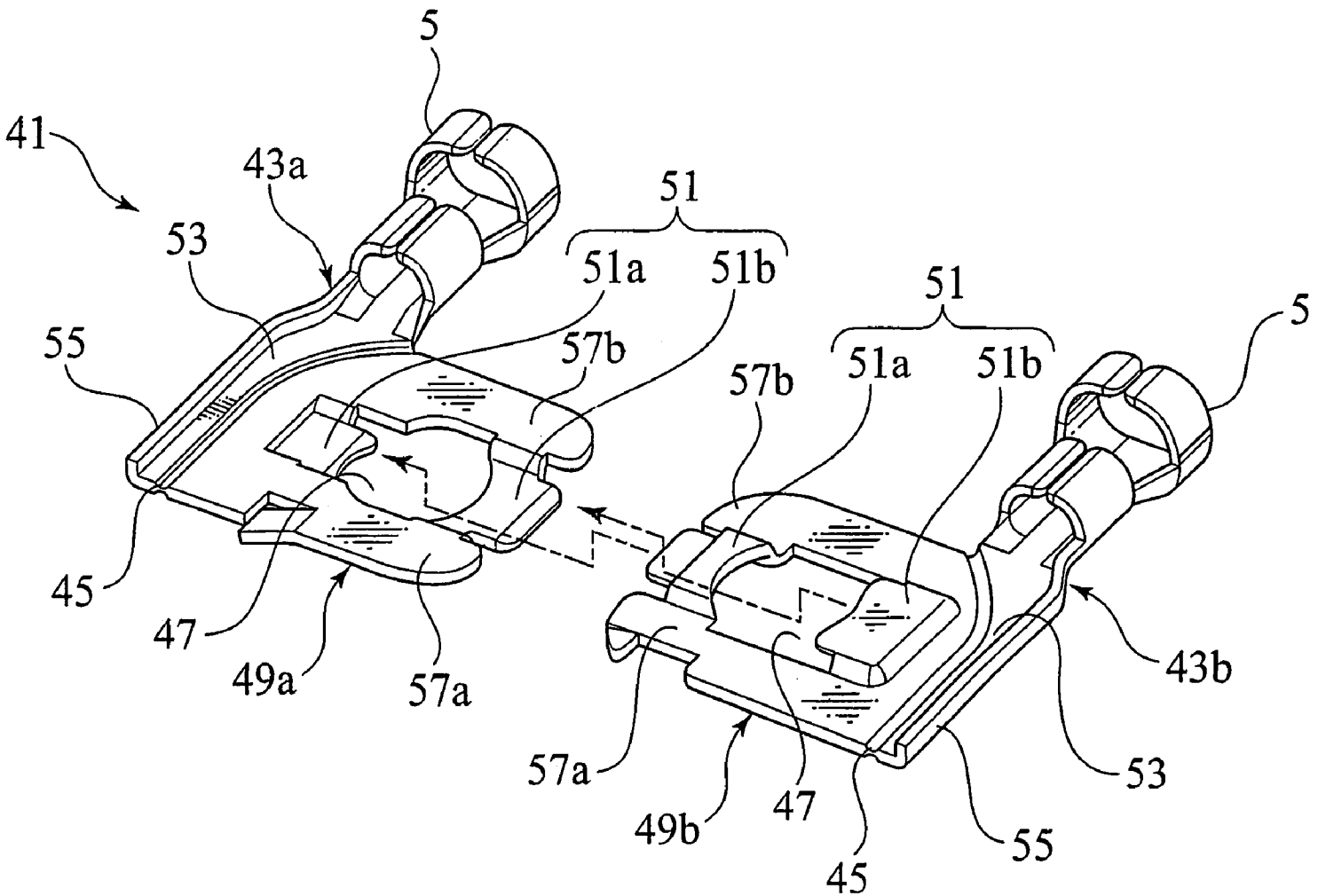
FIG. 8 is a perspective view of the metal terminal in accordance with the second embodiment of the present invention.
Figure 9:
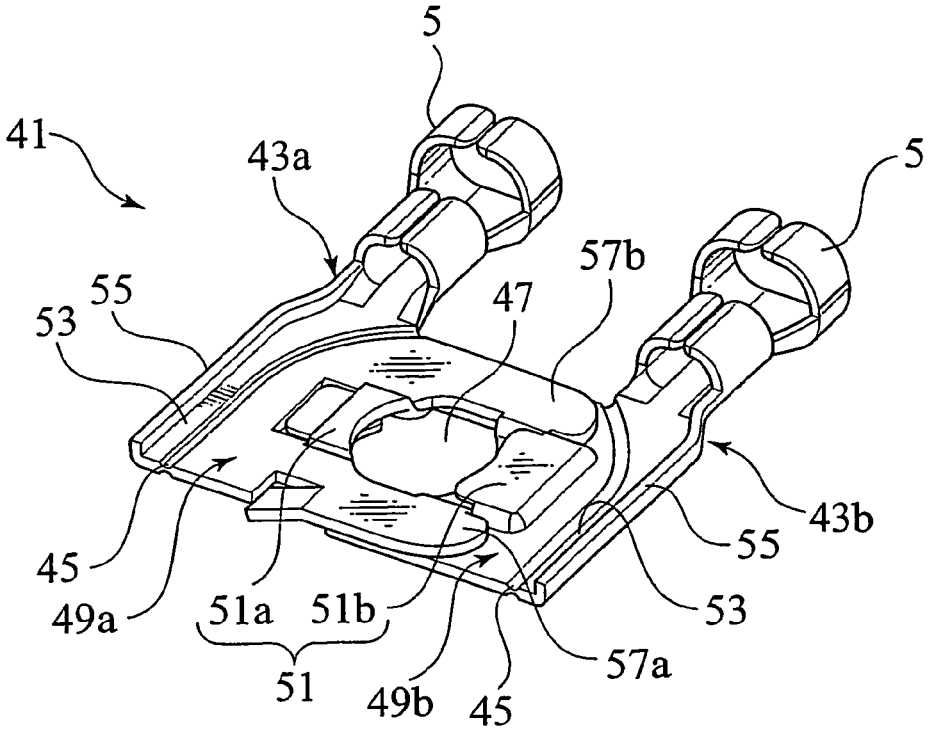
FIG. 9 is a perspective view of the metal terminal of FIG. 8, showing respective fastening parts of the metal terminal are integrated.
Figure 10:
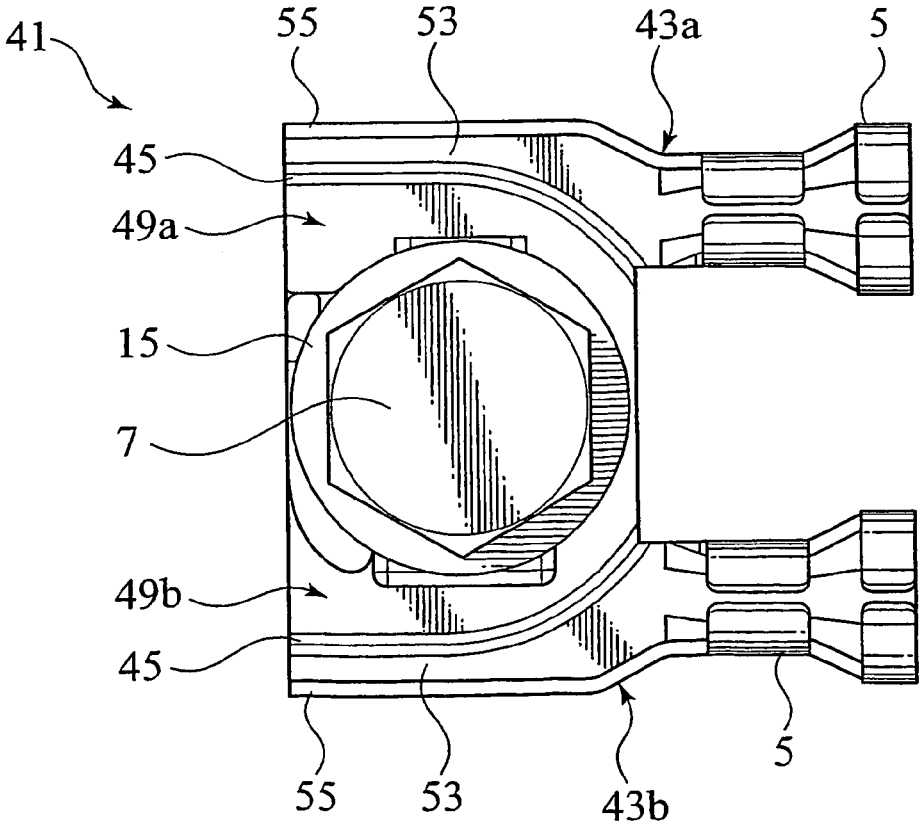
FIG. 10 is a plan view showing a condition that the metal terminal of FIG. 9 is fixed to the vehicle body.

FIGS. 8 to 11 show the second embodiment of the present invention. In these figures, elements identical to those of the first embodiment are indicated with the same reference numerals respectively and their 5 detailed descriptions are eliminated. FIG. 8 is a perspective view of the metal terminal of the second embodiment. FIG. 9 is a perspective view of the metal terminal of FIG. 8, showing respective fastening parts of the metal terminal are integrated into one body. FIG. 10 is a plan view showing a condition that the metal terminal of FIG. 9 is fixed to the vehicle body.

Figure 1:
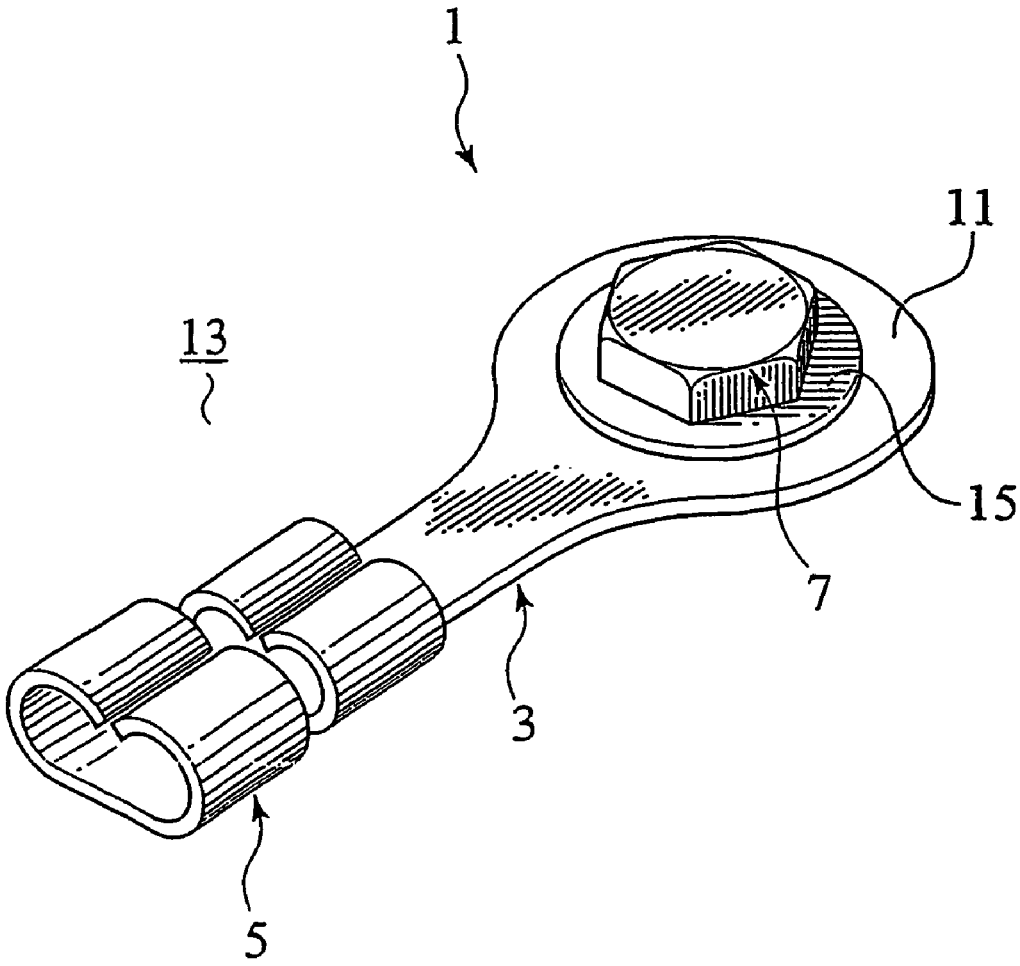
FIG. 1 is a perspective view of a proposed metal terminal in earlier technology related to the present invention.
Figure 2:
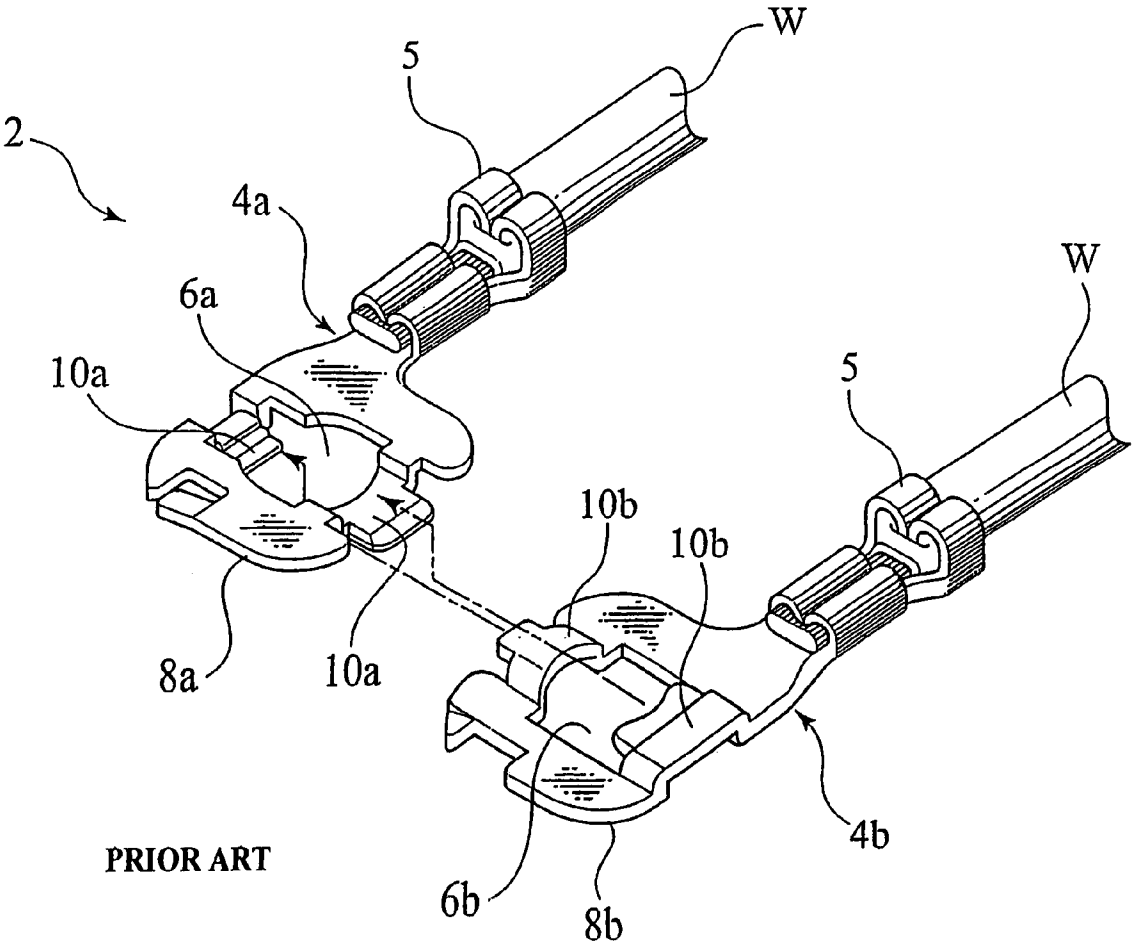
FIG. 2 is a perspective view of another proposed metal terminal in earlier technology related to the present invention.
Figure 3:
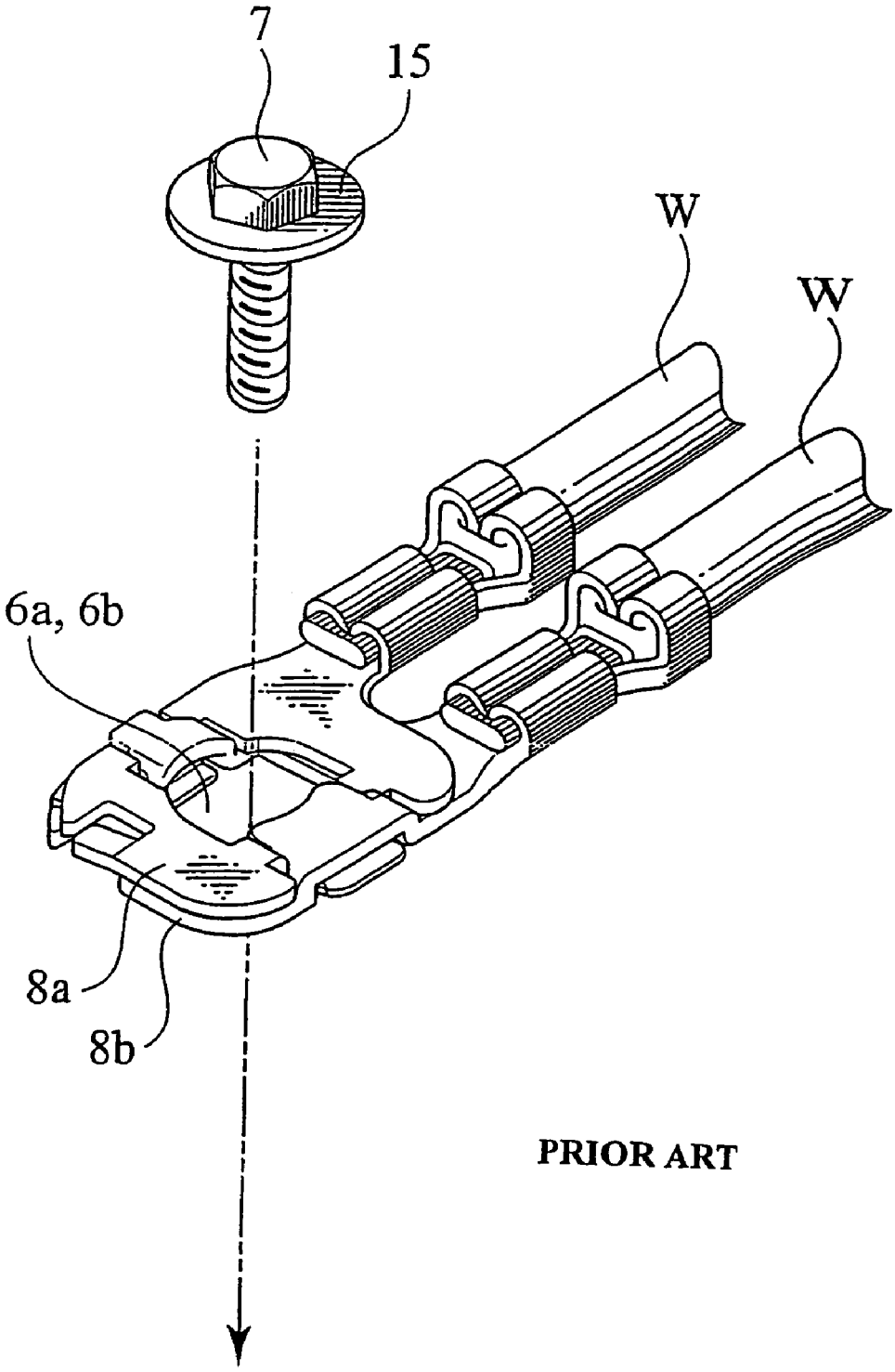
FIG. 3 is a perspective view of the metal terminal of FIG. 2, showing a case of fastening the metal terminal to a vehicle body.

The metal terminal 41 of this embodiment includes two plate-shaped terminal bodies 43*a*, 43*b* having the respective crimp parts 5, 5 to be crimped to a plurality of wires (e.g. two wires), two fastening parts 49*a*, 49*b* connected with the terminal bodies 43*a*, 43*b* through breaking parts 45, 45, respectively and having respective through-holes 47 for passage of the bolt 7 (FIG. 2), and two engaging parts 51, 51 provided in the fastening parts 49*a*, 49*b* to be engageable with each other.

As shown in FIG. 8, the terminal bodies 43*a*, 43*b* are shaped to be line-symmetrical to each other when they are arranged in parallel. In view of constitution, the terminal bodies 43*a*, 43*b* are identical to each other. Therefore, we now describe the structure of the terminal body 43*a* representatively. As to the other terminal body 43*b*, elements identical to those of the terminal body 43*a* are indicated with the same reference numerals, respectively.

The terminal body 43*a* is made from an elongated metal plate. The terminal body 43*a* is provided, one side in the longitudinal direction, with a projecting part 53 which projects from its end face of the body 43*a* along the longitudinal direction and also provided, on the other side of the body 43*a* in the longitudinal direction, with the crimp part 5.

As shown in FIGS. 8 to 10, the projecting part 53 is shaped so that one lateral edge and the other lateral side in the width direction extend along the longitudinal direction of the terminal body 43*a*. The terminal bodies 43*a*, 43*b* are formed so that, when arranging them in parallel, one lateral edge of the projecting part 53 of the body 43*a* is opposed to one lateral edge of the projecting part 53 of the terminal body 42*b*. The projecting part 53 has its one lateral edge which is curved so that its dimension in the width direction gradually decreases from its base part till the intermediate part in the longitudinal direction.

On the other hand, the projecting part 53 is provided, on the other lateral edge in the width direction, with a rib 55 which extends in the longitudinal direction to project upward, that is, in the opposite direction to the fastening direction of the bolt 7. Owing to the provision of the rib 55, the rigidity of the projecting part 53 is improved.

These terminal bodies 43*a*, 43*b* are connected, on one side in the longitudinal direction, with the fastening parts 49*a*, 49*b* through the breaking parts 45, 45, respectively. As shown in FIG. 8, the fastening parts 49*a*, 49*b* and the breaking parts 45, 45 are line-symmetrical to each other when the terminal bodies 43*a*, 43*b* are arranged in parallel. In view of constitution, the fastening parts 49*a*, 49*b* and the breaking parts 45, 45 are identical to each other. Therefore, as similar to the terminal bodies 43*a*, 43*b*, we now describe the structures of the breaking part 45 and the fastening part 49*a* representatively. As to the other breaking part 45 and the fastening part 49*b*, elements identical to those of the terminal body 43*a* are indicated with the same reference numerals, respectively.

As shown in FIGS. 8 to 10, the breaking part 45 is formed along the one edge of the projecting part 53. That is, in plan view, the breaking part 45 is curved on its base side close to the crimp part 5 partially. In section, the breaking part 45 is formed by upper and lower concave faces. That is, the breaking part 45 is formed to have a thin wall in comparison with a thickness of the terminal body, exhibiting flexibility. Consequently, by pulling the terminal body 43*a* up and down in relation to the later-mentioned fastening part 49*a*, there is produced a shearing force for breakage of the breaking part 45.

The above fastening part 49*a* is shaped to be a substantially-rectangular plate. In the width direction, the fastening part 49*a* has its one side connected to the breaking part 45. The fastening part 49*a* is provided, on the other side in the width direction, with plate parts 57*a*, 57*b* which are opposed to each other in the longitudinal direction of the part 49*a*. In the fastening part 49*a*, the opposing plate part 57*a* has its outer edge in alignment with the leading edge of the projecting part 53. Further, the fastening part 49*a* is provided, between the opposing plate parts 57*a*, 57*b*, with the engaging part 51.

The engaging part 51 has a pair of fitting parts 51*a*, 51*b* on both sides of the through-hole 47 in the width direction of the fastening part 49*a*. The fitting part 51*a* is in the form of a dent of the upper face of the fastening part 49*a*, providing a designated step. Similarly, the fitting part 51*a* is in the form of another dent of the upper face of the fastening part 49*a*, providing another designated step.

In engagement, as shown in FIGS. 8 and 9, the engaging part 51 of the fastening part 49*a* is engaged with the engaging part 51 of the fastening part 49*b*. Then, the fitting parts 51*a*, 51*b* of the fastening part 49*a* are fitted to the steps of the fitting parts 51*a*, 51*b* of the fastening part 49*b*, while the fitting parts 51*a*, 51*b* of the fastening part 49*b* are fitted to the steps of the fitting parts 51*a*, 51*b* of the fastening part 49*a*. In this way, both of the engaging parts 51, 51 of the fastening parts 49*a*, 49*b* are laid to overlap each other.

When using the metal terminal 41 constructed above, it is first carried out to caulk the crimp parts 5 of the terminal bodies 43*a*, 43*b* to the wires' ends each having its insulating cover peeled. Subsequently, the fastening parts 49*a*, 49*b* are engaged with each other through their respective engaging parts 51, 51. Next, the so-integrated metal terminal 41 is fastened to the vehicle body 13 by the bolt 7.

In engaging the fastening parts 49*a*, 49*b* with each other through the engaging parts 51, 51, it is first carried out to juxtapose the terminal bodies 43*a*, 43*b*, as shown in FIG. 8. Next, by sliding the fastening parts 49*a*, 49*b* close to each other, their engaging parts 51, 51 are laid to overlap each other, as shown with broken lines of FIG. 8. Then, the fitting parts 51*a*, 51*b* of the fastening part 49*a* are engaged with the fitting parts 51*b*, 51*a* of the fastening part 49*b*, so that the terminal bodies 43*a*, 43*b* are integrated to complete the metal terminal 41. Thereafter, the so-integrated fastening parts 49*a*, 49*b* are fastened to the vehicle body 13 by the bolt 7 while interposing the washer 15, as shown in FIG. 10.

In this state, the metal terminal 41 serves to gather respective ends of the plural wires (not shown) and fix them to the vehicle body 13, effecting the electrical connection between the wires and the vehicle body 13. Since the breaking parts 45, 45 are curved on their respective base sides, the breaking parts 45, 45 are prevented from being broken by an unintentional force.

Figure 11:
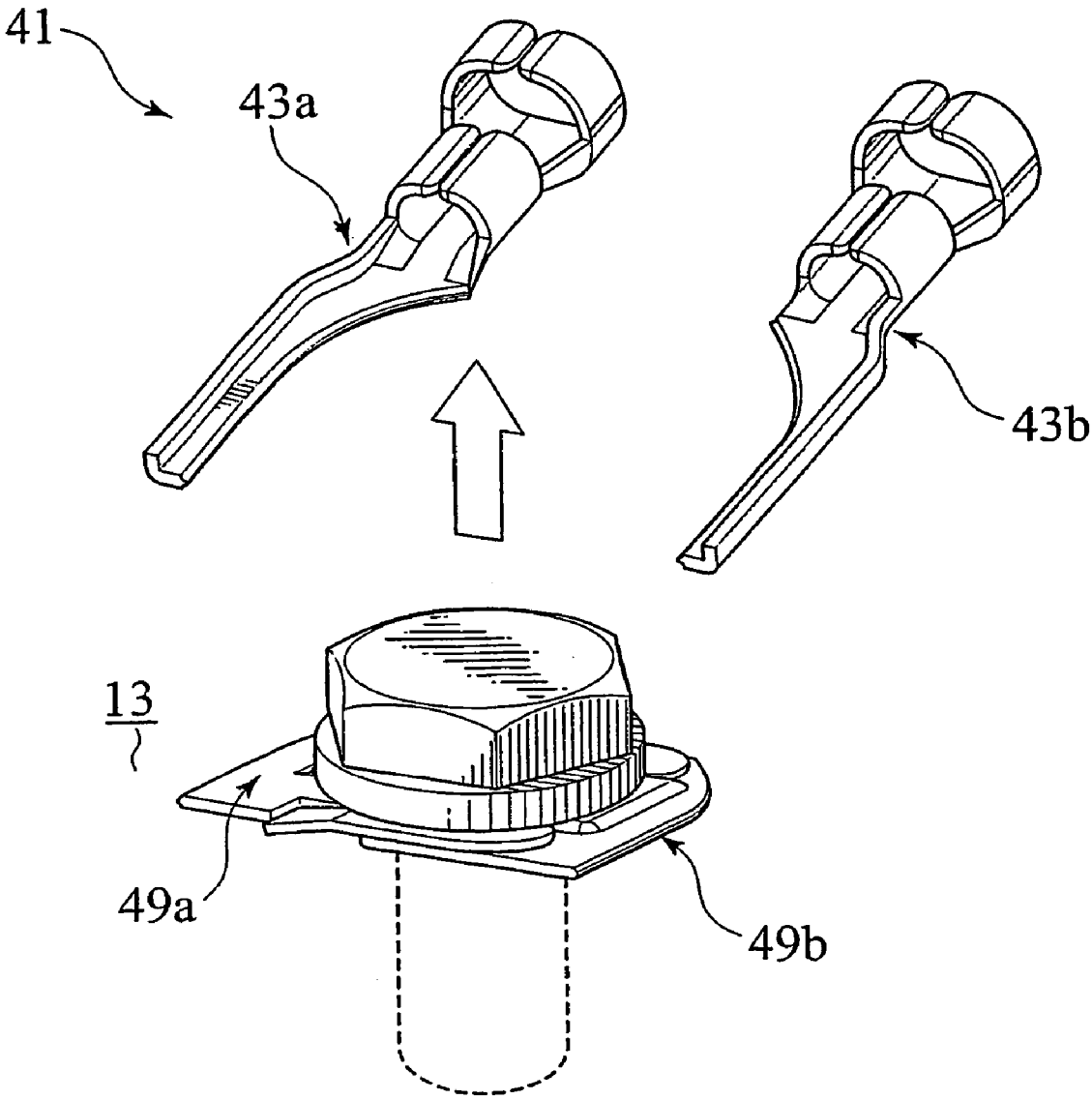
FIG. 11 is a perspective view of the metal terminal of FIG. 10, showing a condition that respective breaking parts of the terminal are broken.

When detaching the metal terminal 41 from the vehicle body 13, the other sides of the terminal bodies 43*a*, 43*b* are pulled up as shown with an arrow of FIG. 11. While bending the breaking parts 45, 45, this pulling operation causes the other sides of the terminal bodies 43*a*, 43*b* to be shifted upward with fulcrums of the tips of the projecting parts 53, 53 abutting on the vehicle body 13. That is, the other side of the metal terminal 41 is somewhat rotated in relation to the fastening parts 49*a*, 49*b*.

Corresponding to the rotation of the terminal bodies 43*a*, 43*b*, the breaking parts 45, 45 between the fastening parts 49*a*, 49*b* and the projecting parts 53, 53 are pulled up and down. Consequently, a shear stress is produced from the base sides of the projecting parts 53, 53. Thus, due to the shear stress, the breaking parts 45, 45 are gradually torn from the base sides of the projecting parts 53, 53 toward their tip sides.

Again noted that the breaking parts 45, 45 are formed along the longitudinal direction of the terminal body 19. Therefore, the pulling force on the other sides of the terminal bodies 43*a*, 43*b* can be mostly converted to a shear force for tearing the breaking parts 45, 45, thereby facilitating their breakage.

Additionally, since the rigidity of the projecting parts 53, 53 is improved by the addition of the ribs 55, 55, it is possible to prevent the terminal bodies 43*a*, 43*b* from being deflected during pulling up the other sides of the terminal bodies 43*a*, 43*b*. Accordingly, it is possible to allow the pulling force on the other sides of the terminal bodies 43*a*, 43*b* to function as the shearing force for tearing the breaking parts 45, 45, thereby also facilitating their breakage.

At the stage of complete breaking of the breaking parts 45, 45, as shown in FIG. 11, the fastening parts 49*a*, 49*b* are respectively separated from the terminal bodies 43*a*, 43*b*, so that they are released from their fixing on the vehicle body 13. In this way, it becomes possible to detach the ends of the wires from the vehicle body 13, together with the terminal bodies 43*a*, 43*b*.

In summary, according to the metal terminal 41 of the above-mentioned embodiment, by pulling up the other sides of the terminal bodies y 43*a*, 43*b*, it is possible to break the breaking parts 45, 45 due to the resultant shearing force.

Therefore, without using any exclusive tool, it is possible to separate the fastening parts 49*a*, 49*b* from the terminal bodies 43*a*, 43*b* and also possible to detach the ends of the wires and the terminal bodies 43*a*, 43*b* from the vehicle body 13, allowing a worker to disassemble the vehicle with ease.

According to the metal terminal 41 of this embodiment, it is also possible to detach either one of the terminal bodies 43*a*, 43*b* from the vehicle body 13 after a plurality of wires have been collectively attached to the vehicle body 13 through the metal terminal 41. This means enabling a designated wire to be detached from the vehicle body 13 together with the corresponding terminal body 43*a* (or 43*b*), thereby facilitating an alteration of the finished circuit on demand.

Again noted that the breaking parts 45, 45 are formed along the longitudinal direction of the terminal bodies 43*a*, 43*b*. Therefore, the pulling force on the other sides of the terminal bodies 43*a*, 43*b* can be mostly converted to a shear force for tearing the breaking parts 45, 45, facilitating their breakage. As a result, it is possible to perform the dissolving work with ease.

Repeatedly, since the breaking parts 45, 45 are partially curved on their respective base sides, the metal terminal 41 is certainly fixed on the vehicle body 13 while preventing the breaking parts 45, 45 from being broken by an unintentional force. Thus, a plurality of wires can be connected with the vehicle body 13 certainly.

Additionally, since the rigidity of the projecting parts 53, 53 is improved by the addition of the ribs 55, 55, it is possible to prevent the terminal bodies 43*a*, 43*b* from being deflected during pulling up the other sides of the bodies 43*a*, 43*b*. Accordingly, it is possible to allow the pulling force on the other sides of the terminal bodies 43*a*, 43*b* to function as the shearing force for tearing the breaking parts 45, 45, also facilitating their breakage. As a result, it is possible to perform the dissolving work more easily.

Further noted that the breaking parts 45, 45 are shaped so as to be thin walls respectively. Therefore, when pulling up the other sides of the terminal bodies 43*a*, 43*b*, the breaking parts 45, 45 can be broken with ease.

Various changes and modifications may be made to the second embodiment of the present invention. For example, although the breaking parts 45, 45 are partially curved on their respective base sides in the shown embodiment, the breaking parts 45, 45 may be partially curved on their tip sides. Alternatively, they may be partially curved at their intermediate portions between the tip sides and the base sides.

[3rd. Embodiment]

Figure 12:
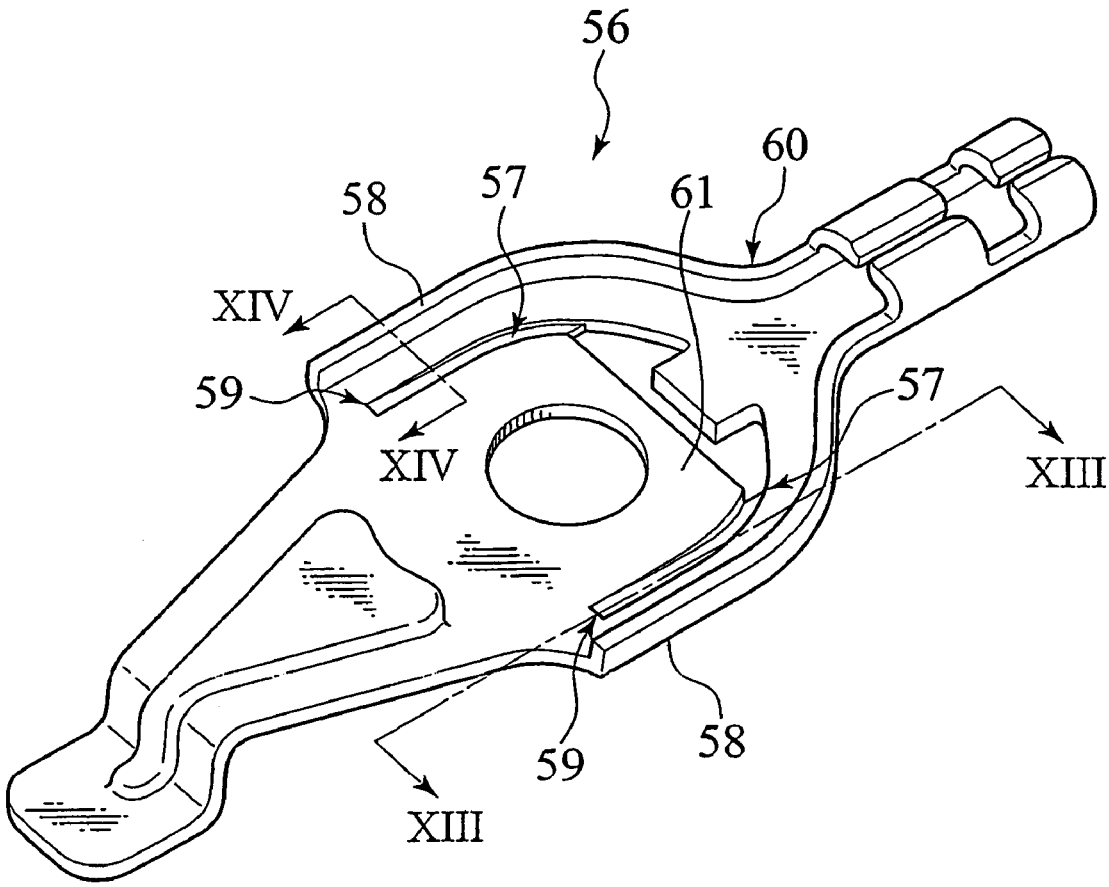
FIG. 12 is a perspective view of the metal terminal in accordance with the third embodiment of the present invention.
Figure 13:
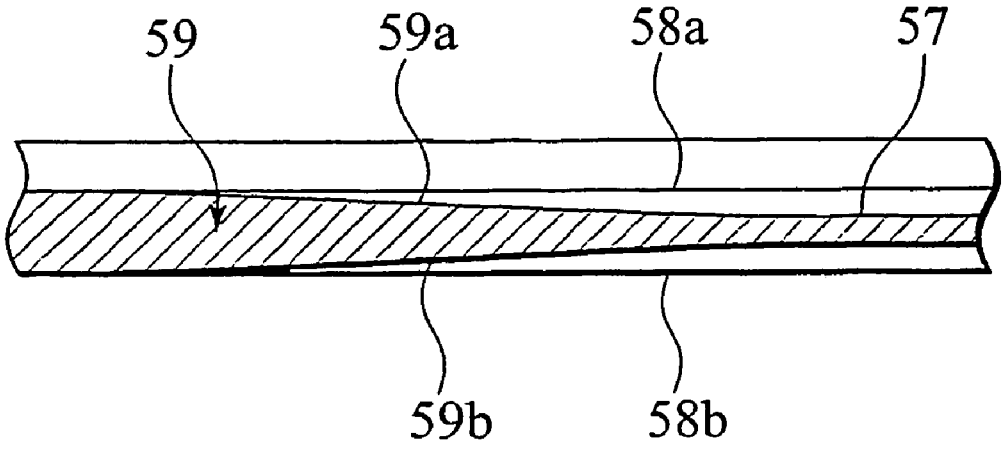
FIG. 13 is a cross-sectional view taken along line XIII—XIII of the breaking part of the metal terminal of FIG. 12.
Figure 14:
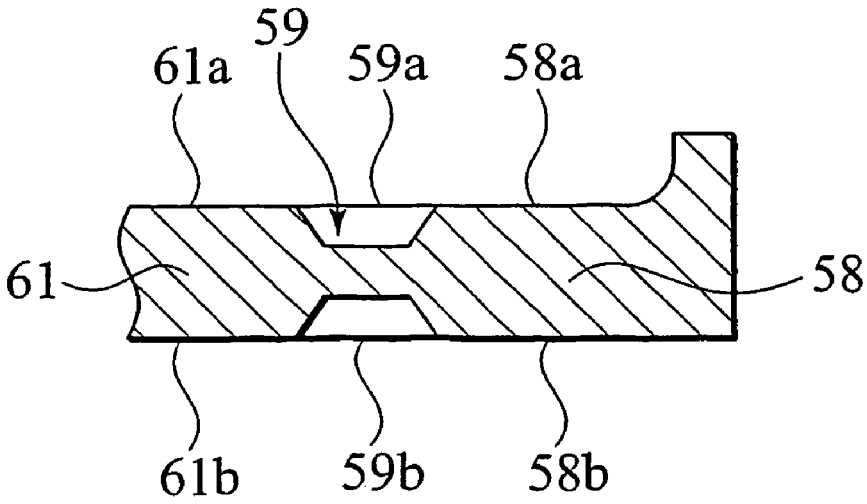
FIG. 14 is a cross-sectional view taken along line XIV—XIV of the breaking part of the metal terminal of FIG. 12.

FIGS. 12 to 14 show the third embodiment of the present invention. In these figures, elements identical to those of the above embodiments are indicated with the same reference numerals respectively and their detailed descriptions are eliminated. FIG. 12 is a perspective view of the metal terminal of the third embodiment. FIG. 13 is a cross-sectional view taken along line XIII—XIII of the breaking part of the metal terminal of FIG. 12. FIG. 14 is a cross-sectional view taken along line XIV—XIV of the breaking part of the metal terminal of FIG. 12.

As shown in FIGS. 12 to 14, the metal terminal 56 of this embodiment is constructed in the same way as the first embodiment. Similarly, the metal terminal 56 is provided with a pair of breaking parts 57, 57 and a pair of projecting parts 58, 58. Each of the breaking parts 57 has a thick-wall part 59 thickened in comparison with a thickness of the breaking part's end on the side of the base end of the projecting part 58.

As similar to the breaking part 45 of the second embodiment, the breaking part 57 is curved in a manner that the width dimension of the projecting part gradually decreases from its end on the base side toward the leading end. The breaking part 57 is partially formed by a thin wall in comparison with the plate thickness of a terminal body 60 and a fastening part 61, providing a groove therebetween. Also, the breaking part 57 is provided, on the leading side of the projecting part 58, with a thick-wall part 59.

As shown in FIGS. 12 and 13, the breaking part 57 has an upper face 59*a* and a lower face 59*b* both inclined from the base side of the projecting part 58 toward the leading end while gradually increasing the thickness of the breaking part 58. The thick-wall part 59 is formed so that, near the leading end of the projecting part 58, the upper face 59*a* defines one plane together with an upper face 58*a* of the projecting part 58 and an upper face 61*a* of the fastening part 61, while the lower face 59*b* defines one plane together with an lower face 58*b* of the projecting part 58 and an lower face 61*b* of the fastening part 61. In other words, the thick-wall part 59 is formed to have a wall thickness equal to the plate thickness of the terminal body 60 and the fastening part 61, at the leading end of the projecting part 58. In brief, the metal terminal 56 of the embodiment has the breaking parts 57, 57 formed to extend from the base sides of the projecting parts 58, 58 to the leading ends and, at the leading ends of the projecting parts 58, 58, the fastening part 61 is directly connected with the terminal body 60. Noted that the thick-wall part 59 is formed so that its width dimension is smaller than that of the other part of the breaking part 57, providing a sectional area substantially equal to that of the other part.

In addition to the similar operation and effects of the first embodiment, owing to the provision of the thick-wall parts 59, 59, it is possible to increase an electrical mass of the breaking parts 57, 57 in case of connecting a wire (not shown) with the vehicle body 13 (FIG. 5) through the metal terminal 56. Consequently, when it is required to ensure a predetermined electrical mass at the breaking parts 57, 57, it is possible to shorten the whole lengths of the breaking parts 57, 57 in comparison with a metal terminal having the breaking parts formed to be thin throughout. Correspondingly, it is also possible to shorten the projecting parts 58, 58, allowing miniaturization of the metal terminal as a whole.

Additionally, according to the metal terminal 56, the rigidity of the breaking parts 57, 57 can be improved owing to the provision of the thick-wall parts 59, 59. Therefore, in fastening the metal terminal 56 to the vehicle body 13, a fastening force of the bolt 7 (FIG. 5) is effectively transmitted to the projecting parts 58, 58 through the thick-wall parts 59, 59, so that there is no possibility of pulling the breaking parts 57, 57 up and down. As a result, it is possible to prevent the breaking parts 57, 57 from being torn unintentionally due to the fastening force of the bolt 7.

When detaching the terminal body 60 from the vehicle body 13, the breakage of the breaking parts 57, 57 starts in the vicinity of the base ends of the projecting parts 58, 58 since the parts 57, 57 are formed thinner on the base sides of the parts 58, 58, respectively. With the progress of breakage of the breaking parts 57, 57, the shearing stress applied thereon is gradually increased so as to tear even the thick-wall parts 59, 59. That is, according to the metal terminal 56, it is possible to accomplish the breakage of the breaking parts 57, 57 in spite of the presence of the thick-wall parts 59, 59.

Further, owing to the formation of the breaking parts 57, 57 each having a gradually-increased thickness, the breakage of the thick-wall parts 59, 59 can be carried out smoothly, corresponding to the breakage of the thin-wall parts of the breaking parts 57, 57. Thus, it is possible to accomplish the breakage of the breaking parts 57, 57 in spite of the presence of the thick-wall parts 59, 59.

Additionally, since the thick-wall parts 59, 59 are positioned apart from the thinnest parts of the breaking parts 57, 57, the rigidity of the parts 59, 59 is hard to affect the initial breakage of the breaking parts 57, 57. Also by this reason, it is possible to accomplish the breakage of the breaking parts 57, 57 in spite of the presence of the thick-wall parts 59, 59.

Hereat, it is noted that an external force is easily applied on respective end faces of the breaking parts 57, 57 (on the leading sides of the projecting parts 58, 58) because of their exposure to the outside. However, owing to the provision of the thick-wall parts 59, 59 of high rigidity, it is possible to prevent the breaking parts 57, 57 from being broken by the external force.

Repeatedly, the metal terminal 56 of this embodiment has the thick-wall parts 59, 59 each formed to have a wall thickness equal to the plate thickness of the terminal body 60 and the fastening part 61, at the leading end of the projecting part 58. In other words, at the leading end of the projecting parts 58, 58, the thick-wall parts 59, 59 connect the fastening part 61 with the terminal body 60 directly. Therefore, it is possible to increase the electrical mass of the breaking parts 57, 57 in spite of ensuring their breakability, whereby the metal terminal 56 can be small-sized furthermore.

Further, with the improved rigidity of the breaking parts 57, 57 at the thick-wall parts 59, 59, it is possible to prevent the breaking parts 57, 57 from being broken by the fastening force of the bolt 7.

Similarly to the previously-mentioned embodiments, various changes and modifications may be made to the third embodiment of the present invention. For example, although the thick-wall parts 59, 59 are respectively arranged on the sides of the leading ends of the projecting parts 58, 58, each of the thick-wall parts 59, 59 may be formed at an intermediate position of the breaking part 57. Additionally, although each breaking part 57 is formed so as to gradually increase its plate thickness in the shown embodiment, the breaking part 57 may be provided with a step part instead of the thick-wall part 59.

Further, although each of the thick-wall parts 59, 59 has a plate thickness equal to the plate thickness of the terminal body 60 and the fastening part 61 in the shown embodiment, the same part 59 has a plate thickness smaller than the plate thickness of the terminal body 60 and the fastening part 61.

Figure 15:
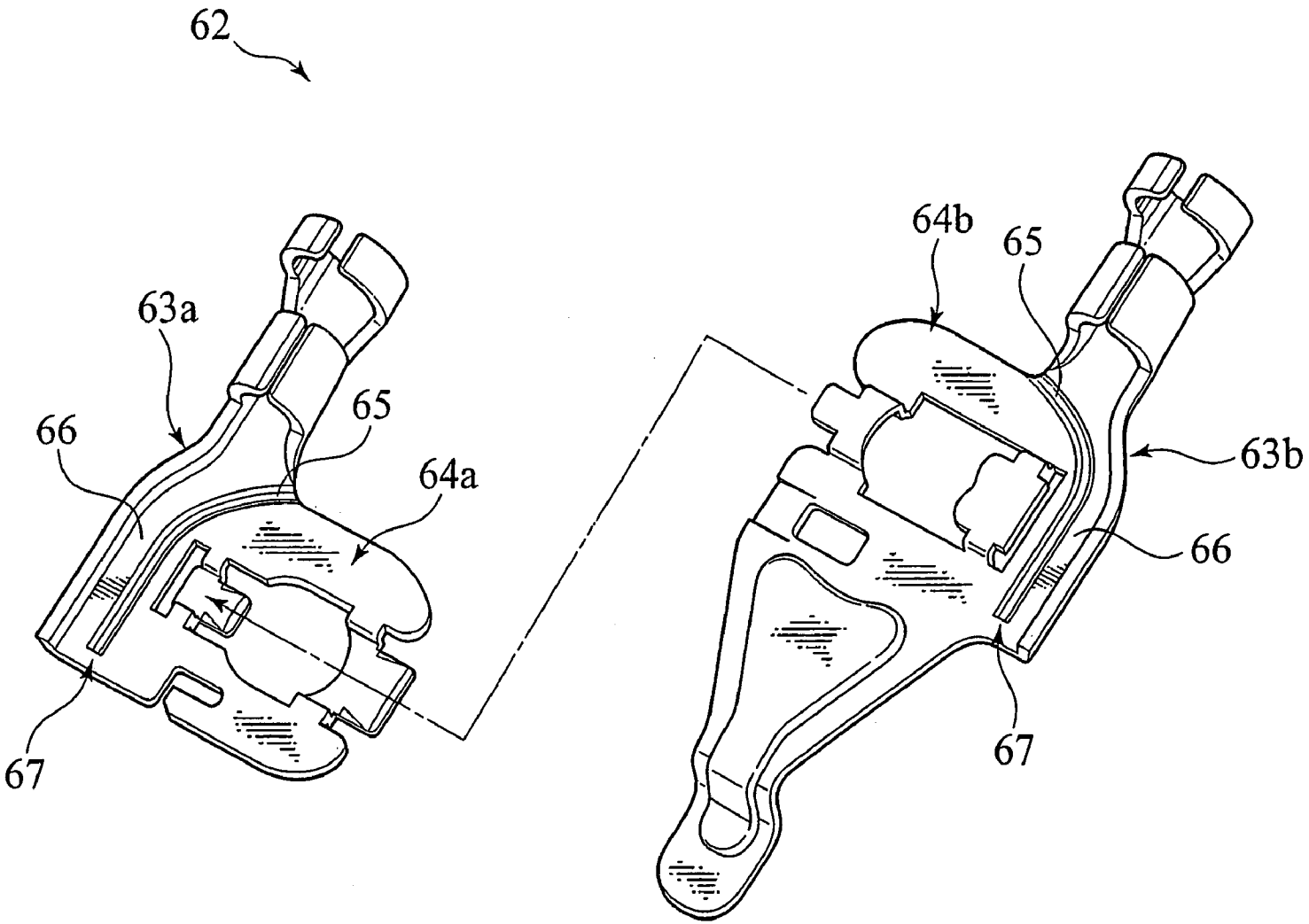
FIG. 15 is a perspective view of the metal terminal in accordance with the modification of the third embodiment of the present invention.
Figure 16:
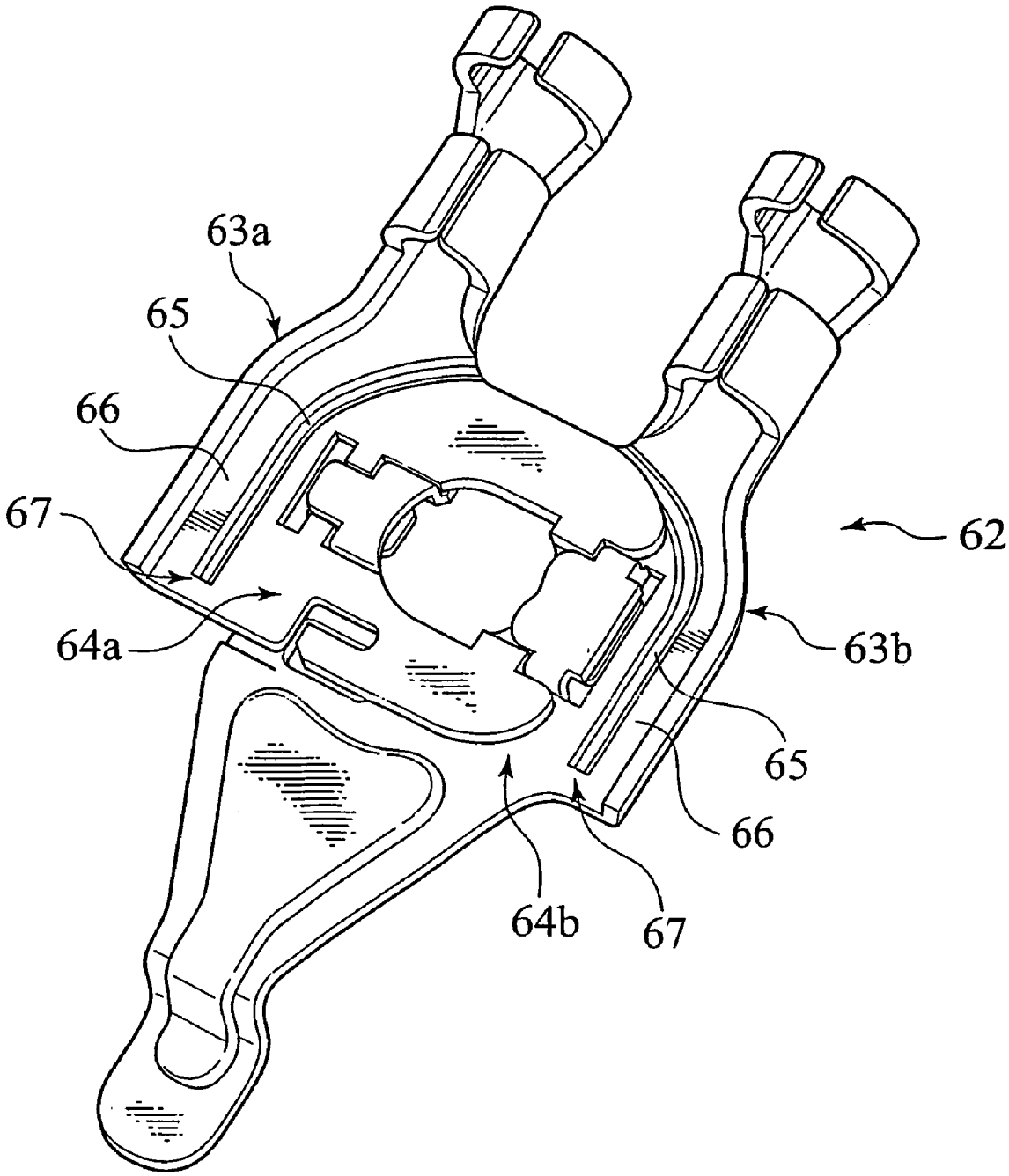
FIG. 16 is a perspective view of the metal terminal of FIG. 12, showing respective fastening parts of the metal terminal are integrated.

The above-mentioned embodiment is also applicable to a metal terminal for connection of a plurality of electrical wires, as shown in FIGS. 15 and 16.

The metal terminal 62 of this modification is similar to the metal terminal 41 of the second embodiment, in terms of constitutions. The metal terminal 62 includes a pair of terminal bodies 63*a*, 63*b*, fastening parts 64*a*, 64*b* and breaking parts 65, 65 each having a plate thickness thinner than the plate thickness of the terminal body 63*a* (63*b*) and also the fastening part 64*a* (64*b*). Similarly, each of the breaking parts 65, 65 has a thick-wall part 67 whose thickness is larger than the plate thickness of the other part of the part 65. The operation and effects of the modification are similar to those of the third embodiment and therefore, their overlapping descriptions are eliminated.

Finally, it will be understood by those skilled in the art that the foregoing description is related to some preferred embodiments of the disclosed metal terminal and that various changes and modifications may be made to the present invention without departing from the spirit and scope thereof.

What is claimed is:

1. A metal terminal comprising:

a terminal body made from a metal plate, the terminal body having a crimp part which is to be crimped to a wire; and a fastening part connected to the terminal body through at least one weakened part, the fastening part having a through-hole formed therein for passage of a fastening member, wherein the terminal body has a co-fastening part having its tip side to be fastened by the fastening member together with the fastening part;

wherein, when the terminal body is pulled in a direction opposite to the fastening direction of the metal terminal by means of the fastening member under condition that the fastening part and the co-fastening part are together fastened by the fastening member, the co-fastening part is released from its fastened condition by applying a breaking force on the weakened part.

2. A metal terminal as claimed in claim 1, wherein the fastening part is formed so as to intersect with the longitudinal direction of the terminal body, and the weakened parts are arranged on both sides of the fastening part.

3. A metal terminal as claimed in claim 1, wherein the co-fastening part is arranged so as to oppose the fastening part in the longitudinal direction of the terminal body.

4. A metal terminal as claimed in claim 1, wherein the through-hole is formed so as to open toward the co-fastening part.

5. A metal terminal as claimed in claim 1, wherein the weakened part is formed along the longitudinal direction of the terminal body, and the breaking force is produced by pulling the terminal body in the direction opposite to the fastening direction while making a fulcrum of either one side of the terminal body in the longitudinal direction or the other side of the terminal body.

6. A metal terminal as claimed in claim 5, wherein the terminal body has at least one rib formed along the weakened part to increase rigidity of the terminal body.

7. A metal terminal as claimed in claim 5, wherein the weakened part includes a part which is formed thinner than the fastened part.

8. A metal terminal as claimed in claim 5, wherein the weakened part includes a plurality of orifices formed to line up along the fastening part at regular intervals.

9. A metal terminal comprising:

a plurality of terminal bodies made from metal plates, the terminal bodies each having a crimp part which is to be crimped to a wire;

a plurality of fastening parts connected to the terminal bodies through weakened parts respectively, the fastening parts each having a through-hole formed therein for passage of a fastening member; and a plurality of engaging parts formed in the fastening parts respectively to allow the fastening parts to be engaged with each other;

wherein, when the terminal body is pulled in a direction opposite to the fastening direction of the fastening parts by means of the fastening member under condition that the fastening parts are engaged with each other by the engaging parts and further fastened by the fastening member, the metal terminal produces a breaking force acting on the weakened part.

10. A metal terminal as claimed in claim 9, wherein the weakened parts are formed along the longitudinal direction of the terminal bodies respectively, and the breaking force is produced by pulling the terminal bodies in the direction opposite to the fastening direction while making a fulcrum of either one side of the terminal bodies in the longitudinal direction or the other side of the terminal bodies.

11. A metal terminal as claimed in claim 9, wherein the weakened parts are partially curved.

12. A metal terminal as claimed in claim 9, wherein each of the terminal bodies has at least one rib formed along the weakened part to increase rigidity of the terminal body.

13. A metal terminal as claimed in claim 9, wherein each of the weakened parts includes a plurality of orifices formed to line up along each of the fastening parts at regular intervals.

14. A metal terminal as claimed in claim 9, wherein each of the weakened parts has a part which is formed to be thinner than each of the fastening parts.

15. A metal terminal as claimed in claim 14, wherein each of the weakened parts has a thick-wall part which is thicker than a breakable end of the weakened part where the breaking force is to be applied at first, the breakable end being thinner than the fastening part.

16. A metal terminal as claimed in claim 15, wherein each of the weakened parts is formed so as to gradually increase a plate thickness from the breakable end toward the thick-wall part.

17. A metal terminal as claimed in claim 15, wherein the thick-wall part is arranged on the opposite side of the breakable end of each of the weakened parts.

18. A metal terminal as claimed in claim 17, wherein the thick-wall part has a plate thickness substantially equal to the plate thickness of each of the terminal bodies and also the plate thickness of each of the fastening parts and is formed so as to succeed to the terminal body and the fastening part continuously.

* * * * *